US010329866B2

(12) United States Patent
Frazee et al.

(10) Patent No.: US 10,329,866 B2
(45) **Date of Patent: *Jun. 25, 2019**

(54) LOCKING KEYED COMPONENTS FOR DOWNHOLE TOOLS

(71) Applicant: Baker Hughes, a GE company, LLC, Houston, TX (US)

(72) Inventors: Clifford Thomas Frazee, Katy, TX (US); Frank J. Maenza, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/722,197

(22) Filed: Oct. 2, 2017

(65) Prior Publication Data

US 2019/0100975 A1 Apr. 4, 2019

(51) Int. Cl.
*E21B 33/12* (2006.01)
*E21B 17/02* (2006.01)

(52) U.S. Cl.
CPC ..... *E21B 33/1208* (2013.01); *E21B 17/023* (2013.01)

(58) Field of Classification Search
CPC ..... E21B 33/128; E21B 33/1208
USPC ..... 166/379
See application file for complete search history.

(56) References Cited

U.S. PATENT DOCUMENTS 2,253,092 A 8/1941 Albert
3,899,631 A 8/1975 Clark
6,173,788 B1 1/2001 Lembcke et al.
7,431,082 B2 10/2008 Holt et al.
7,611,339 B2 11/2009 Tetzlaff et al.
7,762,322 B2 7/2010 Andersen et al.
7,836,960 B2 11/2010 Patel et al.
8,083,000 B2 12/2011 Nutley et al.
8,215,394 B2 7/2012 Cascario et al.
8,459,367 B2 6/2013 Nutley et al.
2015/0226023 A1* 8/2015 Scruggs ..... E21B 47/12 166/250.1

OTHER PUBLICATIONS

Easywell; Swellpacker Cable System, Achieve Complete Zonal Isolation in Intelligent Wells and Reduce Completion Costs Oct. 2007.

* cited by examiner

*Primary Examiner* — Taras P Bemko
(74) *Attorney, Agent, or Firm* — Parsons Behle & Latimer

(57) ABSTRACT

A tool for use in a wellbore that includes a mandrel having an interior and an exterior with a plurality of keyed ring members along the exterior of the mandrel having an external line that runs the length of the tool. The tool may include a packing element positioned between at least a first keyed ring member and a keyed second ring member. A line is run between the exterior of the mandrel and an interior of the packing element, through an inner bore of the first ring, and through an inner bore of the second ring. Key members may be removed from the ring members to permit the insertion of the line through the packer system. The key members may be removed to removal of a ring component from the packer system. The key members and ring component enable a tool to be constructed onsite at a wellbore.

15 Claims, 7 Drawing Sheets

LOCKING KEYED COMPONENTS FOR DOWNHOLE TOOLS

RELATED APPLICATIONS

This patent application is related to U.S. patent application Ser. No. 15/722,160 filed on Oct. 2, 2017, and entitled "OPEN-HOLE MECHANICAL PACKER WITH EXTERNAL FEED THROUGH AND RACKED PACKING SYSTEM" and U.S. patent application Ser. No. 15/722,271 filed on Oct. 2, 2017, and entitled "OPEN-HOLE MECHANICAL PACKER WITH EXTERNAL FEED THROUGH RUN UNDERNEATH PACKING SYSTEM," the contents of each of which are hereby incorporated by reference in their entirety.

FIELD OF THE DISCLOSURE

The disclosure is related to the field of locking keyed members for downhole tools having an external feed through and methods of using locking keyed members with downhole tools having an external feed through.

BACKGROUND

Description of the Related Art

In wellbore operations, a packer assembly system may sometimes be used to create a seal between an uphole portion of a wellbore and a downhole portion of the wellbore in order to enable operations to be performed by one or more tools on a string within the downhole portion. Various mechanisms may be used to form a seal with a sealing or packing element between the tool and a wall of the wellbore. Any interruptions between a packing element, or a sealing element, of the packer assembly system and the wellbore wall may prevent proper sealing and may adversely affect operations in the wellbore.

A typical packer assembly system may not provide accommodations for communication lines and/or control lines to be inserted within the packer system. If accommodations are provided, in a typical packer assembly, the line may be run either through the packing element, through an exterior of the packer assembly system, or through a drilled hole in the mandrel, which may result in the packer assembly not sealing completely when set within a wellbore. Some packer assemblies may rely on swellable materials to try to reduce this potential problem. However, in a mechanically set packer assembly, swellable materials may not be compatible with a packing or sealing element. Further, after assembly a typical packer assembly system may not enable a line to be subsequently inserted into an interior of the packer assembly. Packer assemblies that provide a line through either the packing element, an exterior of the packer assembly, or through the mandrel typically require splicing the communication and/or control line above and below the packer assembly. Splices in a communication line and/or a control line may significantly degrade signal quality and may, therefore, adversely affect operations within the wellbore. Further, splices in the line may present a weak point in a line, which may affect the integrity of the seal provided by the packer.

Various downhole tools may include an external line for controlling and/or communication to a location below the downhole tool. Such tools may require the external line to be spliced above and below the tool in order to provide the desired control and/or communication. As discussed herein, splices in a line may provide weak points along the line. Other disadvantages may exist.

SUMMARY

The present disclosure is directed to locking keyed members for use in a downhole tool having an external line. For example, a downhole packer system for use in a wellbore may include a line that needs to bypass the packing element of the packer system. The packer system may be positioned along a string and includes a line that traverses the packer system along the string without the use of splices.

An embodiment of the disclosure is a packer system for use in a wellbore comprising a mandrel having an interior and an exterior. The system comprises a packer assembly including a packing element positioned between a first ring and a second ring, which is configured to slide onto the exterior of the mandrel. The first ring includes a first gap along the first ring between a first end and a second end. The system comprises a line configured to run between the exterior of the mandrel and an interior of the packing element, through an inner bore of the first ring, and through an inner bore of the second ring. The system comprises a first key member, wherein the gap is configured to receive the first key member.

The insertion of the first key member into the first gap may selectively interlock the first key member with the first and second ends of the first ring. Removal of the first key member from the first gap may enable the line to pass from the inner bore of the first ring to an exterior of the first ring. The first key member may comprise a metal, a polymer, a thermoplastic, an elastomeric, and/or a combination thereof.

The system may include a second key member and a second gap configured to receive the second key member, the second gap being along the second ring between a first end and a second end, wherein the insertion of the second key member into the second gap may selectively interlock the second key member with the first and second ends of the second ring. The first key may have a first cross-sectional geometry and the second key may have a second cross-sectional geometry, which differs from the first cross-sectional geometry. Removal of the second key member form the second gap may enable the line to pass from the inner bore of the second ring to an exterior of the second ring.

The system may include a third key member and a third gap along the first ring, the third gap being between a third end and a fourth end of the first ring. The third gap may be configured to receive the third key member, wherein insertion of the third key member into the third gap may selectively interlock the third key member with the third and fourth ends of the first ring. The first and third gaps may be approximately 180 degrees apart along the first ring. Removal of the first key member from the first gap and removal of the third key member from the third gap may separate the first ring into two separate components.

One embodiment of the present disclosure is a method of providing a packer system. The method comprises providing a packer assembly on a mandrel, the packer assembly including a first ring, a packing element, and a second ring, wherein the packing element is positioned between the first and second ring. The method comprises installing a line between an exterior of the mandrel and an inner surface of the packing element, through an inner bore of the first ring, and through an inner bore of the second ring. The line may be installed through a gap along the first ring and a second gap along the second ring.

The method may comprise inserting a first key member into the first gap and inserting a second key member into the second gap after installing the line. The first key member may be inserted in a longitudinal direction with respect to a longitudinal centerline of the mandrel. The first key member may be inserted in a transverse direction with respect to a longitudinal centerline of the mandrel. The first key member may selectively interlock with the first ring and the second key member may selectively interlock with the second ring. The method may include removing the first key member from the first gap and removing the first ring from the packer assembly, wherein the line passes from the inner bore of the first ring through the first gap.

An embodiment of the disclosure is a packer assembly comprising a first ring having a first end, a second end, and a first gap between the first and second ends. The assembly comprises a second ring having a first end, a second end, and a second gap between the first and second ends. The assembly comprises a sealing element positioned between the first and second rings, wherein the first ring is movable with respect to the second ring, the movement of the first ring towards the second ring causes the sealing element to expand radially. The assembly comprises a first key member configured to be inserted into the first gap, wherein the first key member positioned within the first gap selectively interlocks with the first and second ends of the first ring and a second key member configured to be inserted into the second gap, wherein the second key member positioned within the second gap selectively interlocks with the first and second ends of the second ring.

The removal of the first key member may enable axial insertion of a line into an inner bore of the first ring. The removal of the second key member may enable axial insertion of a line into an inner bore of the second ring. The first key member may be configured to prevent insertion of the first key member into the second gap and the second key member may be configured to prevent insertion of the second key member into the first gap.

An embodiment of the disclosure is a tool comprising a mandrel having a first end, a second end, and an exterior and a first ring member positioned on the exterior of the mandrel, the first ring member having a first gap configured to receive a first key. The tool comprises a second ring member positioned on the exterior of the mandrel, the second ring member having a second gap configured to receive a second key member. The tool comprises first and second keys. The tool may include a line that extends along the exterior of the mandrel from the first end of the mandrel to the second end of the mandrel, the line passing between the first ring member and the exterior of the mandrel and passing between the second ring member and the exterior of the mandrel. The tool may include a plurality of slips positioned on the exterior of the mandrel between the first ring member and the second ring member.

Figure 1:
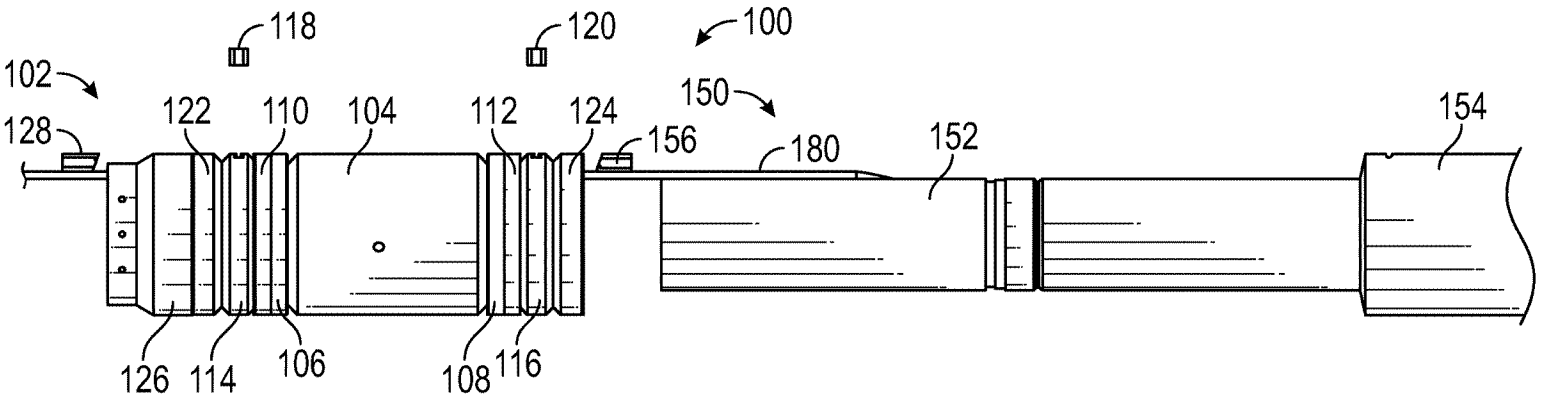
FIG. 1 is a schematic view of an embodiment of a packer system with a packer assembly positioned adjacent to a mandrel of a base assembly of the packer system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 is a schematic view of a packer system 100 with a packer assembly 102 positioned adjacent to a mandrel 152 of a base assembly 150 of the packer system 100. As discussed in the above referenced related patent applications entitled "OPEN-HOLE MECHANICAL PACKER WITH EXTERNAL FEED THROUGH AND RACKED PACKING SYSTEM" and "OPEN-HOLE MECHANICAL PACKER WITH EXTERNAL FEED THROUGH RUN UNDERNEATH PACKING SYSTEM" it may be beneficial to run a continuous line, such as line 180 shown in FIG. 1, down a work or tubing string that does not require splices to traverse tools along the string. The line 180 may provide communication with a downhole location and/or control of a downhole device as would be appreciated by one of ordinary skill in the art having the benefit of this disclosure. The line 180 may be a pneumatic line, an electrical line, an optical line, or another type of line capable of control and/or communication. As the line 180 travels along the string it may need to negotiate a downhole tool. For example, the line 180 may need to bypass a packer system 100 that may be used to create a seal between the system 100 and a wellbore. The packer system 100 may be a packer system 100 used to create a seal in an openhole wellbore.

Figure 3:
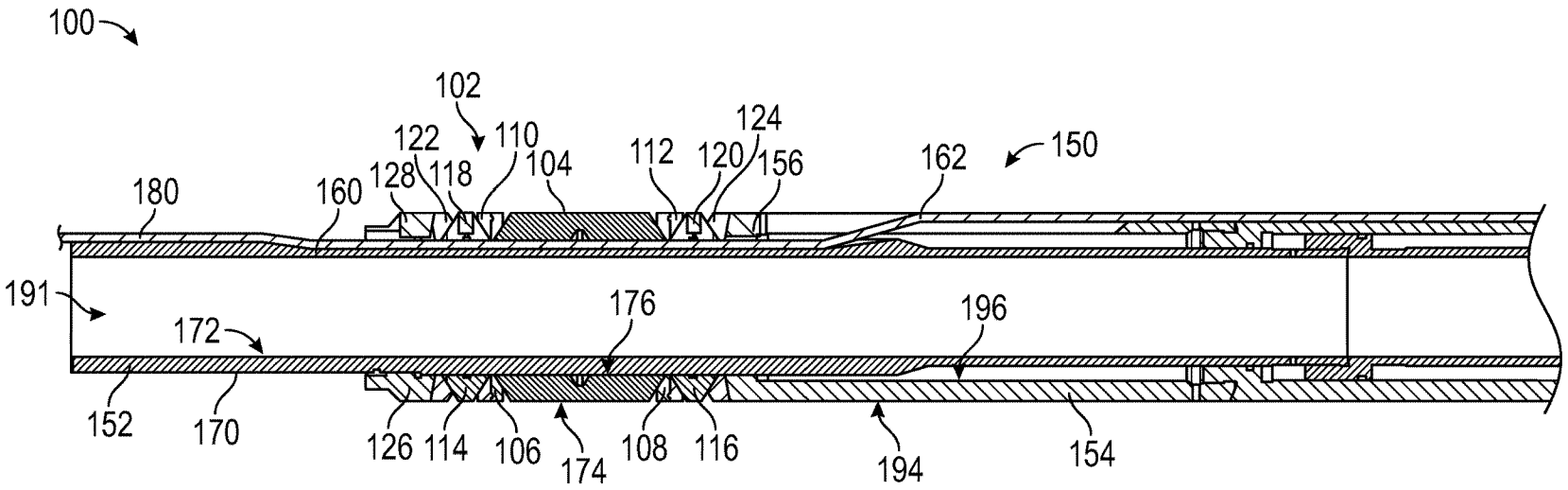
FIG. 3 is a cross-section schematic view of an embodiment of a packer system.
Figure 4A:
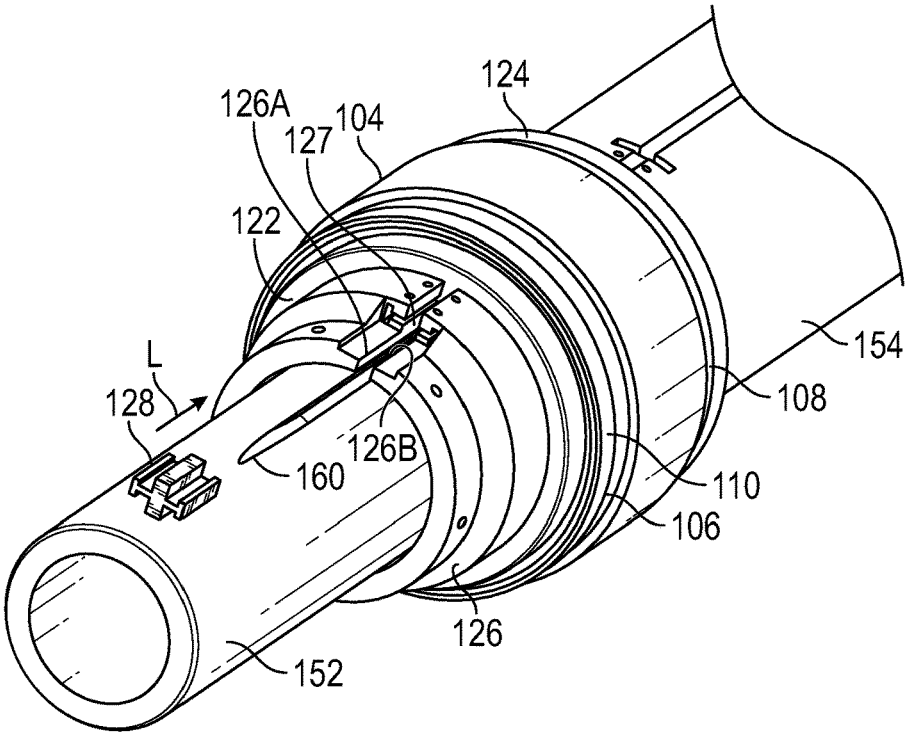
FIGS. 4A and 4B are partial schematic views of an embodiment of a packer system with the packing element in an expanded or set configuration.
Figure 4B:
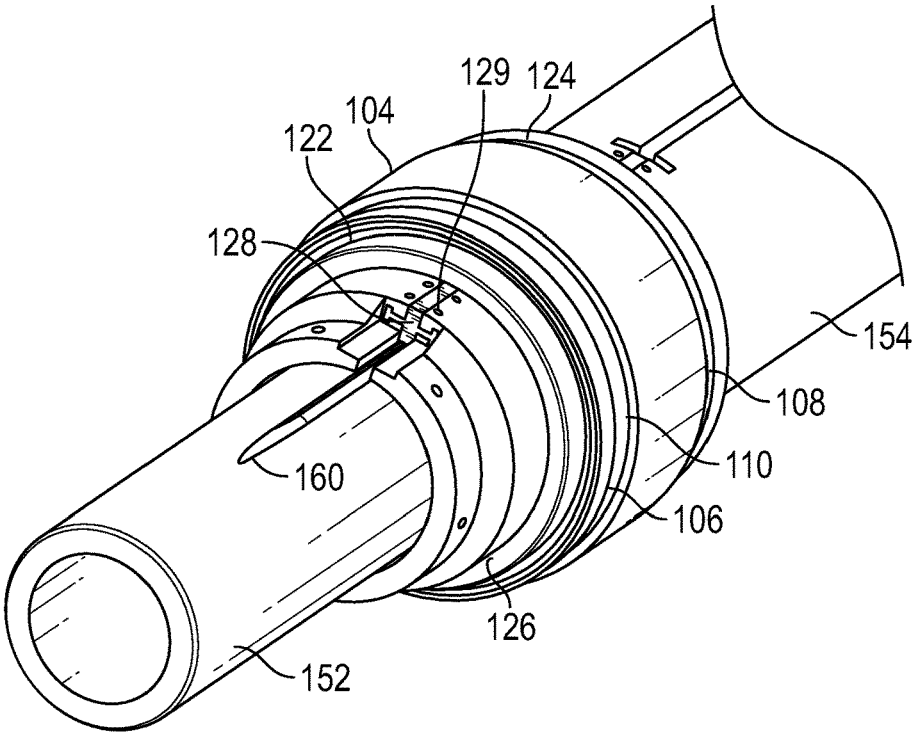

The packer system 100 includes a packer assembly 102 that may be actuated to move a packer or sealing element 104 between an unset or unexpanded state (shown in FIG. 1) and a set or expanded state (shown in FIGS. 4A and 4B). In the set or expanded state, the packer or sealing element 104 creates a seal between the packer system 100 and a portion of a wellbore. Specifically, a seal may be created between the outer portion 174 (shown in FIG. 3) of the packer or sealing element 104 and a portion of the wellbore as would be appreciated by one of ordinary skill in the art. The packer system 100 includes a pathway that enables a line 180 to pass between an inner portion or inner surface 176 (shown in FIG. 3) of the packer or sealing element 104 and an exterior 170 (shown in FIG. 3) of the mandrel 152. The exterior 170 of the mandrel 152 may include a recess or groove 160 that enables the line 180 to traverse between the exterior 170 of the mandrel 152 and the interior or inner surface 176 of the packing element 104. After traversing the packer assembly 102, the line 180 may pass through a recess or slot 162 in the housing 154 to the exterior of the housing 154.

The packing assembly 102 may comprise various ring elements on a first or uphole side of the packer or sealing element 104 and various ring elements on a second or downhole side of the packer or sealing element 104. On a first side of the packing assembly 102 relative to the packing element 104, the packing assembly 102 may include a first inner grooved c-ring 106 and a first outer grooved c-ring 110 that are positioned adjacent to a first end of the packer element 104 with the first inner grooved c-ring 106 being positioned between the packer element 104 and the first outer grooved c-ring 110. The packing assembly 102 may include a first keyed inner wedge ring 114 positioned between the first outer grooved c-ring 110 and a first wedge c-ring 122. A keyed gauge ring 126 may be positioned on one end of the packer assembly 102 adjacent to the first wedge c-ring 122.

Figure 2:
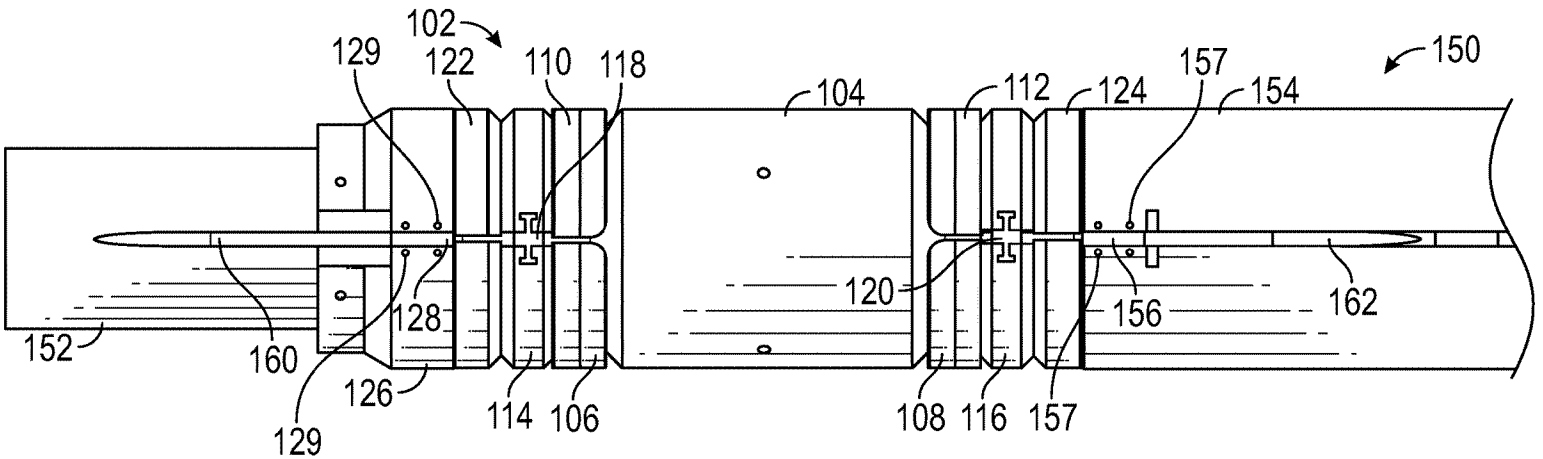
FIG. 2 is a schematic view of an embodiment of a packer system with the packer assembly positioned on the mandrel of the base assembly of the packer system.

On a second side of the packing assembly 102 relative to the packing element 104, the packing assembly 102 may include a second inner grooved c-ring 108 and a second outer grooved c-ring 112 that are positioned adjacent to a second end of the packer element 104 with the second inner grooved c-ring 108 being positioned between the packer element 104 and the second outer grooved c-ring 112. The packing assembly 102 may include a second keyed inner wedge ring 116 positioned between the second outer grooved c-ring 112 and a second wedge c-ring 124. The second wedge c-ring 124 may be positioned against a housing 154 of the base assembly 150, as shown in FIG. 2. The housing 154 includes an exterior 194 (shown in FIG. 3) and an interior 196 (shown in FIG. 3) and is positioned against the second wedge c-ring 124 to prevent the movement of the "second side" ring elements 108, 112, 116, 124 of the packer assembly 102 along the mandrel 152 in a direction away from the "first side" ring elements 106, 110, 114, 122, 126 as the packer assembly 102 is mechanically actuated to set the packing element 104. Various mechanisms may be used to mechanically set the packer assembly 102 by causing the movement of the first ring elements 106, 110, 114, 122, 126 towards the second ring elements 108, 112, 116, 124 to compress the packing element 104 causing to expand outward radially as would be appreciated by one of ordinary skill in the art. Additionally, a packing element of a packer assembly may be set in various ways as would be appreciated by one of ordinary skill in the art. The packer assembly 102 may be formed as a sub assembly and then slide onto the exterior 170 of the mandrel 152 as discussed in detail in the above referenced related application entitled "OPEN-HOLE MECHANICAL PACKER WITH EXTERNAL FEED THROUGH AND RACKED PACKING SYSTEM." Alternatively, the packer assembly 102 may be installed component by component on a mandrel 152 of a base assembly 150 of a packer system 100.

The packer assembly 102, whether formed as a subassembly or installed component by component on a mandrel 152, includes a plurality of key members 118, 120, 128, 156, which may be inserted into various gaps located in components of the packer assembly 102. The key members may be retained in the gaps by various mechanisms. For example, the key members may be configured to be an interference fit with a corresponding gaps. Alternatively, the key members may be selectively secured within a gap via fasteners, an adhesive, by welding, or by various other mechanisms that would be appreciated by one of ordinary skill in the art having the benefit of this disclosure.

The insertion of each key member into a gap of a component of the packer assembly 102 may complete the component and provide structural support thereto. For example, a first key member 118 may be inserted into a gap in the first keyed inner wedge ring 114. The first key member 118 may interlock a first end and a second end of the first keyed inner wedge ring 114 together as the first key member 118 is inserted into a gap between the first and second end. The first key member 118 may be configured to be an interference fit with the gap in the first keyed inner wedge ring 114. The first key member 118 may be selectively removed to permit installation or removal of the first keyed inner wedge ring 114 from the packer system 100. For example, in the instance that the first keyed inner wedge ring 114 needs to be replaced from a packer system 100, the packer assembly 102 may be slid off the end of the mandrel 152 and the removal of the first key member 118 enables the first keyed inner wedge ring 114 to be removed off of the line 180 without having to run the first keyed inner wedge ring 114 to end of the line 180 or, alternatively, having to cut and re-splice the line 180. Likewise, a replacement first keyed inner wedge ring 114 may be installed onto the line 180 through a gap in the ring first keyed inner wedge ring 114. Afterwards, the first key member 118 may be inserted into the gap into the first keyed inner wedge ring 114 to interlock the ends of the first keyed inner wedge ring 114 together.

Likewise, a second key member 120 may be inserted into a gap in the second keyed inner wedge ring 116. The second key member 120 may interlock a first end and a second end of the second keyed inner wedge ring 116 together as the second key member 120 is inserted into a gap between the first and second end. The second key member 120 may be configured to be an interference fit with the gap in the second keyed inner wedge ring 116. The second key member 120 may be selectively removed to permit installation or removal of the second keyed inner wedge ring 116 from the packer system 100. For example, in the instance that the second keyed inner wedge ring 116 needs to be replaced from a packer system 100, the packer assembly 102 may be slid off the end of the mandrel 152 and the removal of the second key member 120 enables the second keyed inner wedge ring 116 to be removed off of the line 180 without having to run the second keyed inner wedge ring 116 to end of the line 180 or, alternatively, having to cut and re-splice the line 180. Likewise, a replacement second keyed inner wedge ring 116 may be installed onto the line 180 through a gap in the second keyed inner wedge ring 116. Afterwards, the second key member 120 may be inserted into the gap into the second keyed inner wedge ring 116 to interlock the ends of the second keyed inner wedge ring 116 together.

The keyed gauge ring 126 may also include a gap that permits the insertion of a key member 128 into the gap to interlock the two ends of the keyed gauge ring 126 together. A plurality of fasteners 129 may be used to selectively retain the key member 128 within the gap of the keyed gauge ring 126. Likewise, the housing 154 may also include a gap that is configured to insert a key member 156 to interlock portions of the housing 154 together. A plurality of fasteners 157 may be used to selectively retain the key member 156 within the gap of the housing 154. As discussed herein, the removal of key members 118, 120, 128, 156 from the components of the packer system 100 may enable each of the components to be installed or replaced by passing a line through a gap in the component.

The packer system 100 is shown with four key members for illustrative purposes only. The keyed gauge ring 126, first wedge c-ring 122, first keyed inner wedge ring 114, first outer grooved c-ring 110, first inner grooved c-ring 106, second inner grooved c-ring 108, second outer grooved c-ring 112, second keyed inner wedge ring 116, second wedge c-ring, and the housing 154 each may include at least one gap configured to receive a key member. Each gap may be configured to a unique key member with respect to the other components of the packer system 100, which may prevent the insertion of the wrong key member into a component. In other words, a key member may be configured to be inserted into a gap located in a specific component of the packer system 100. Alternatively, the key members may be interchangeable and used on any gap in a component depending on the application. In some embodiments, the rings 106, 108, 110, 112, 122, 124 may include gaps that are left open in order to allow for the rings to expand radially. Such gaps also may enable the rings to be removed off the line 180 as described herein as would be appreciated by one of ordinary skill in the art having the benefit of this disclosure.

The number, shape, size, and/or configuration of the ring elements is shown for illustrative purposes only and may be varied depending on the application as would be appreciated by one of ordinary skill in the art having the benefit of this disclosure. As used herein, a "first ring" comprises any element configured to be positioned around the mandrel 152 on a first side of the packer element 104 and a "second ring" comprises any element configured to be positioned around the mandrel 152 on a second side of the packer element 104. The number, shape, size, and/or configuration of the key members is shown for illustrative purposes only and may be varied depending on the application as would be appreciated by one of ordinary skill in the art having the benefit of this disclosure.

FIG. 3 is a cross-section view schematic of a packer system 100. The packer system 100 includes a packer assembly 102 positioned on an exterior 170 of a mandrel 152. The mandrel 152 includes an inner surface 172 and a bore 191. A line 180 travels along the exterior 170 of the mandrel 152 until it reaches the packer assembly 102. The line 180 then travels between an inner surface 176 of the packer element 104 of the packer assembly 102 and the exterior 170 of the mandrel 152. The mandrel includes a groove or recess 160 that permits the passage of the line 180 between the mandrel 152 and the packer or sealing element 104. After traversing the packer assembly 102, the line 180 passes to the exterior 194 of the housing 154 via a slot or groove 162 in the housing 154. The line 180 may then travel down a string (not shown) connected to the packer system 100 to a desired downhole location within a wellbore.

The packer assembly 102 includes various first ring elements 106, 110, 114, 122, 126 positioned on a first side of the packer element 104 and various second ring elements 108, 112, 116, 124, 154 positioned on a second side of the packer element 104 as discussed herein. Each ring element or component 106, 108, 110, 112, 114, 116, 122, 124, 154 may include a key member positioned within a gap along the ring member. First key members 118, 128 and second key members 120, 156 are shown herein for illustrative purposes only. A key member may be removed from a ring element or component 106, 108, 110, 112, 114, 116, 122, 124, 154 to permit the ring element or component to be removed from the packer system 100, as discussed herein. Additionally, the key members (shown herein as 118, 120, 124, 156) may be removed from a component to permit access to the line 180 positioned within the bore of the component. Likewise, the key members may be removed to permit the insertion of the line 180 along the packer system 100 as would be appreciated by one of ordinary skill in the art having the benefit of this disclosure.

FIG. 4A is a partial schematic view of the packer system 100 with the packer or sealing element 104 in a compressed or set configuration. FIG. 4A shows the key member 128 removed out of a gap 127 in the keyed gauge ring 126. Line 180 is not shown in FIGS. 4A and 4B for clarity. The gap 127 is positioned between a first end 126A of the keyed gauge ring 126 and a second end 126B of the keyed gauge ring 126. The gap 127 is configured to receive the key member 128. In other words, the shape of the gap 127 conforms to the shape of the key member 128. The key member 128 is inserted into the gap 127 in a longitudinal direction with respect to a longitudinal centerline of the mandrel 152, as indicated by arrow L. The key member 128 may include a plurality of flanges to interlock the key member 128 with the ends 126A, 126B of the keyed gauge ring 126 when inserted into the gap 127, as shown in FIG. 4B. The shape, size, and/or configuration of the key member 128 is shown for illustrative purposes and may be varied depending on the application as would be appreciated by one of ordinary skill in the art having the benefit of this disclosure.

Figure 5A:
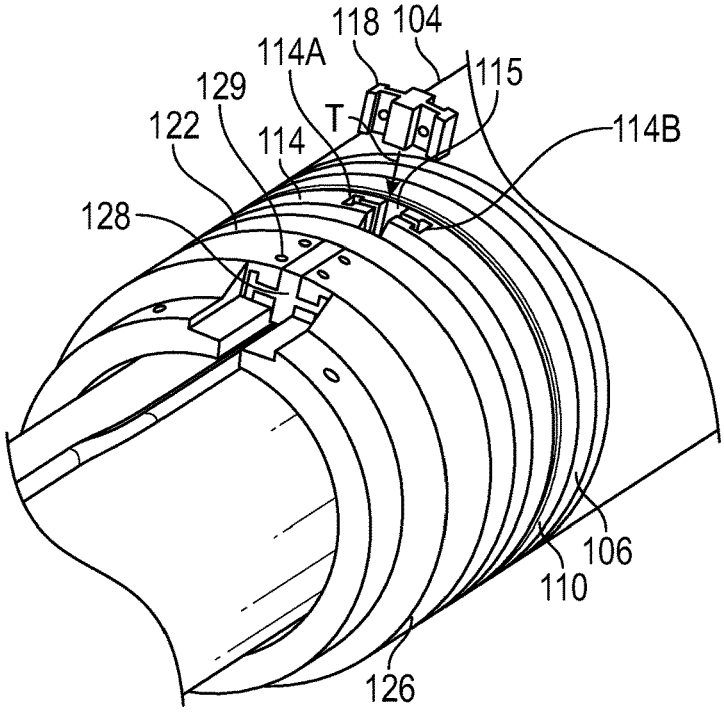
FIGS. 5A and 5B are partial schematic views of an embodiment of a packer system.
Figure 5B:
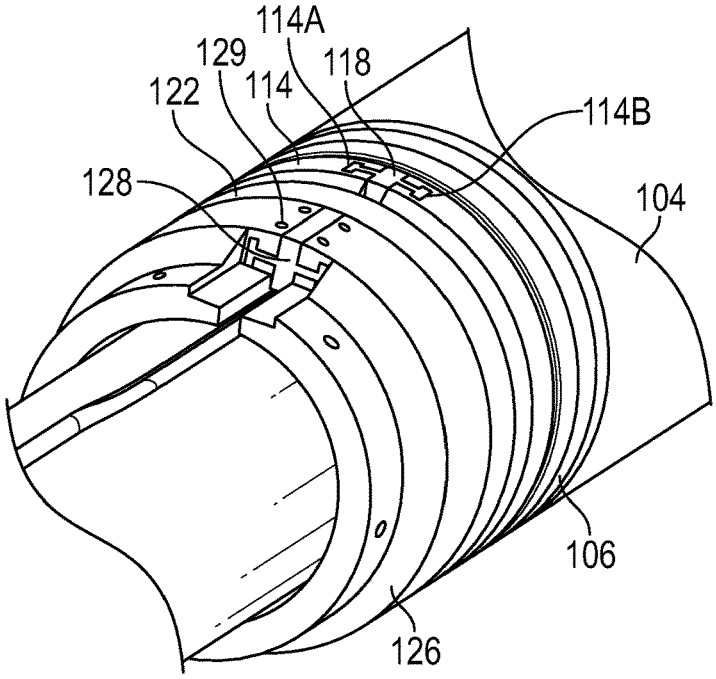

FIGS. 5A and 5B are partial schematic view of the packer system 100. FIG. 5A shows the key member 118 removed out of a gap 115 in the first keyed inner wedge ring 114. The gap 115 is positioned between a first end 114A of the first keyed inner wedge ring 114 and a second end 114B of first keyed inner wedge ring 114. The gap 115 is configured to receive the key member 118. In other words, the shape of the gap 115 conforms to the shape of the key member 118. The key member 118 is inserted into the gap 115 in a transverse direction with respect to a longitudinal centerline of the mandrel 152, as indicated by arrow T. The key member 118 may include a plurality of flanges to interlock the key member 118 with the ends 114A, 114B of first keyed inner wedge ring 114 when inserted into the gap 115, as shown in FIG. 5B. The shape, size, and/or configuration of the key member 118 is shown for illustrative purposes and may be varied depending on the application as would be appreciated by one of ordinary skill in the art having the benefit of this disclosure.

First key members 118, 128 are shown in FIGS. 4A, 4B, 5A, and 5B for illustrative purposes only. The shape, configuration, size, and/or direction of insertion may be varied depending on application as would be appreciated by one of ordinary skill in the art having the benefit of this disclosure. Key members may be may be selectively inserted and removed from various elements of the packer system 100, such as but not limited to, ring elements or component 106, 108, 110, 112, 114, 116, 122, 124, 154. The key members may enable ring elements or components to be removed from the packer system 100, as discussed herein. The key members and ring elements configured to receive a key member may enable a packer system 100 to be constructed onsite at a wellbore. Additionally, the key members may be removed from a component to permit access to the line 180 positioned within the bore of the component. Likewise, the key members may be removed to permit the insertion of the line 180 along the packer system 100 as would be appreciated by one of ordinary skill in the art having the benefit of this disclosure. The insertion of key members into a component may lock that component into place on the mandrel 152 of the packer system 100.

Figure 6:
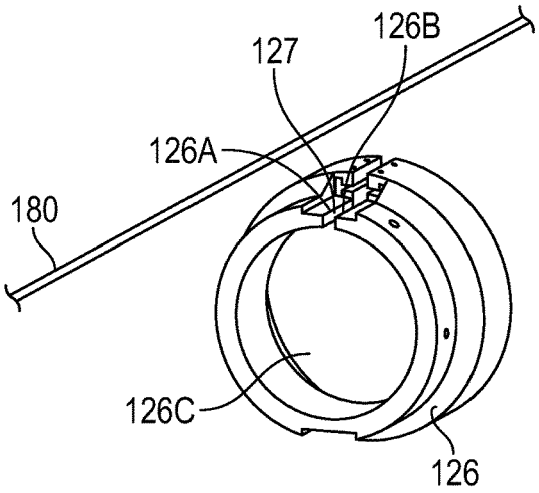
FIG. 6 is a schematic view of an embodiment of a ring component of a packer system that has been removed off of a continuous line that runs along the packer system.

FIG. 6 is a schematic showing the keyed gauge ring 126 removed from off the line 180. After key member 128 from the gap 127 between the ends 126A, 126B in the keyed gauge ring 126, the keyed gauge ring 126 may be slid off the mandrel 152 and the line 180 may pass through the gap 127 to permit the removal of the keyed gauge ring 126 from the packer system 100. Likewise, a replacement keyed gauge ring 126 may be installed within the packer system 100 by passing the line 180 through the gap 127 into the bore 126C of the keyed gauge ring 126. The keyed gauge ring 126 may then be slid onto the mandrel 152 of the packer system 100 and positioned adjacent the first wedge c-ring 122. The key member 128 may be inserted into the gap 127 to close the gap 127. The keyed gauge ring 126 shown in FIG. 6 is for illustrative purposes only as each keyed ring component of the packer system 100 may be removed or installed in the same manner.

Figure 7A:
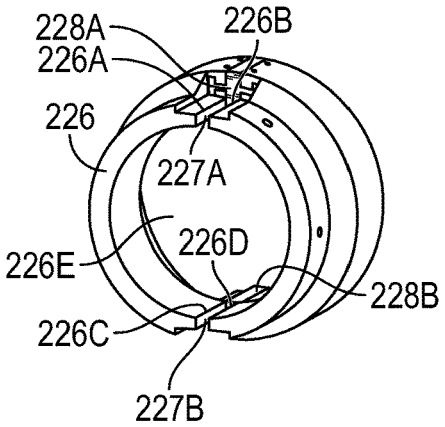
FIGS. 7A and 7B are schematic views of an embodiment of a ring component of a packer system.

FIG. 7A is a schematic of an embodiment of a keyed gauge ring 226 that includes a first key member 228A inserted into a first gap 227A and a second key member 228B inserted into a second gap 227B. The first gap 227A is positioned between a first end 226A of the keyed gauge ring 226 and a second end 226B of the keyed gauge ring 226. The second gap 227B is positioned between a third end 226C of the keyed gauge ring 226 and a fourth end 226D of the keyed gauge ring 226. The keyed gauge ring 226 includes a bore 226E that permits the insertion of a mandrel 152 of a packer system 100 and line 180 as discussed herein. The first and second key members 228A, 228B may have the same cross-sectional geometry permitting them to be interchangeable. Alternatively, the first and second key members 228A, 228B may have different cross-sectional geometries so that only the first key member 228A may be inserted into the first gap 227A and only the second key member 228B may be inserted into the second gap 227B. The first and second gaps 227A, 227B may be positioned approximately 180 degrees apart from each other around the keyed gauge ring 226.

Figure 7B:
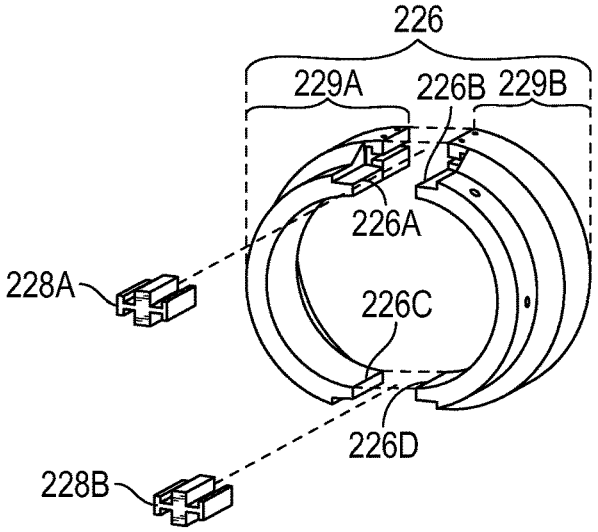

FIG. 7B is a schematic of the keyed gauge ring 226 of FIG. 7A with the first and second key members 228A, 228B removed from the first and second gaps 227A, 227B, which permits the keyed gauge ring 226 to be separated into two individual or separate components 229A, 229B. The removal of two key members 228A, 228B from two gaps 227A, 227B may enable the keyed gauge ring 226 to be removed from off the mandrel 152 of the packer system 100 without having to slide it off the mandrel 152 first. The number, size, configuration, and location of the gaps and key member is for illustrative purposes only and may be varied as would be appreciated by one of ordinary skill in the art having the benefit of this disclosure. For example, three key members and gaps could be used to selectively separate a ring component into three individual parts. The keyed gauge ring 226 shown in FIGS. 7A and 7B is for illustrative purposes only as each keyed ring component of the packer system 100 may include multiple gaps and key members to permit the removal and/or installation in the same manner.

Figure 8:
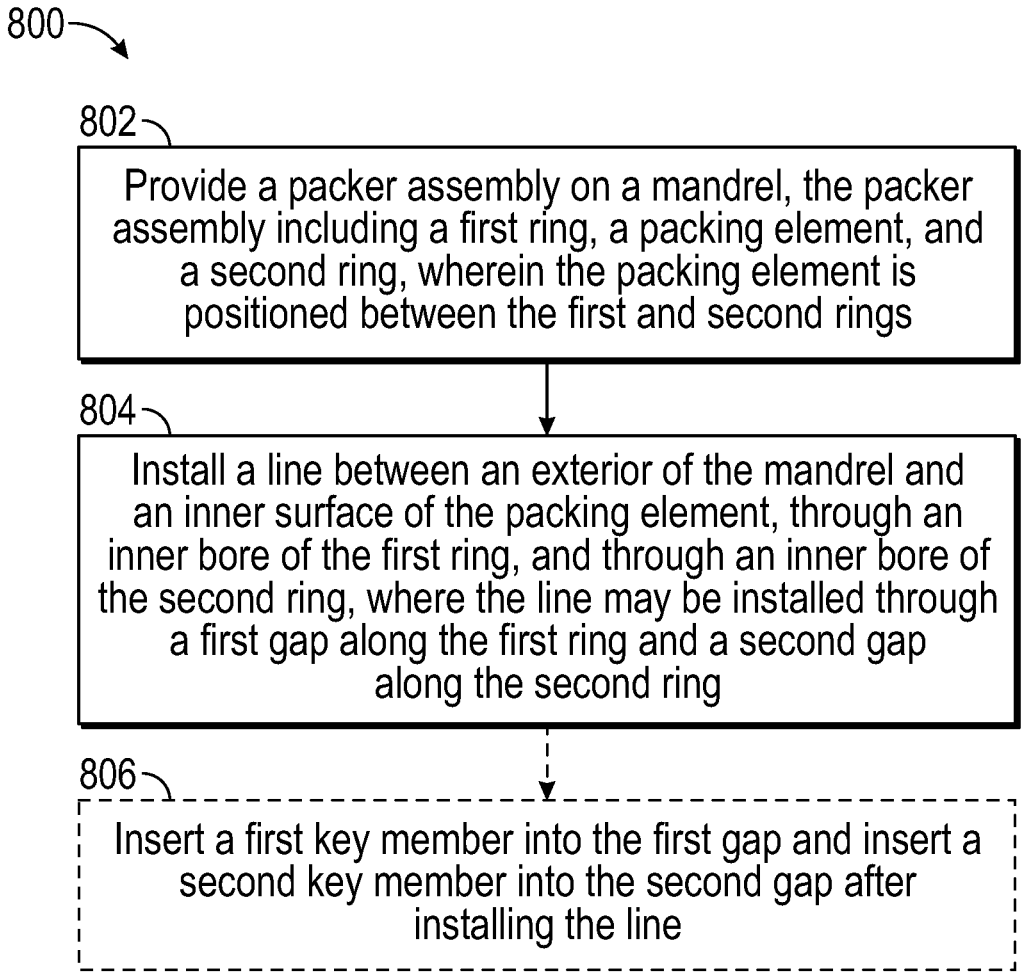
FIG. 8 is a flow chart of an embodiment of a method of providing a packer system.

FIG. 8 is a flow chart of an embodiment of a method 800 of providing a packer system. The method 800 includes the step 802 of providing a packer assembly on a mandrel, the packer assembly including a first ring, a packing element, and a second ring, where the packing element is positioned between the first and second rings. The method includes installing a line between an exterior of the mandrel and an inner surface of the packing element, through an inner bore of the first ring, and through an inner bore of the second ring where the line may be installed through a first gap along the first ring and a second gap along the second ring, at step 804. The method 800 may include inserting a first key member into the first gap and inserting a second key member into the second gap after installing the line, at step 806. The first key member may be inserted in a longitudinal direction with respect to a longitudinal centerline of the mandrel or the first key member may be inserted in a transverse direction with respect to the longitudinal centerline of the mandrel. The first key member may interlock with the first ring and the second key member may interlock with the second ring. The method may include removing the first key member from the first gap and removing the first ring from the packer assembly, wherein the line passes from the inner bore of the first ring through the first gap.

Figure 9:
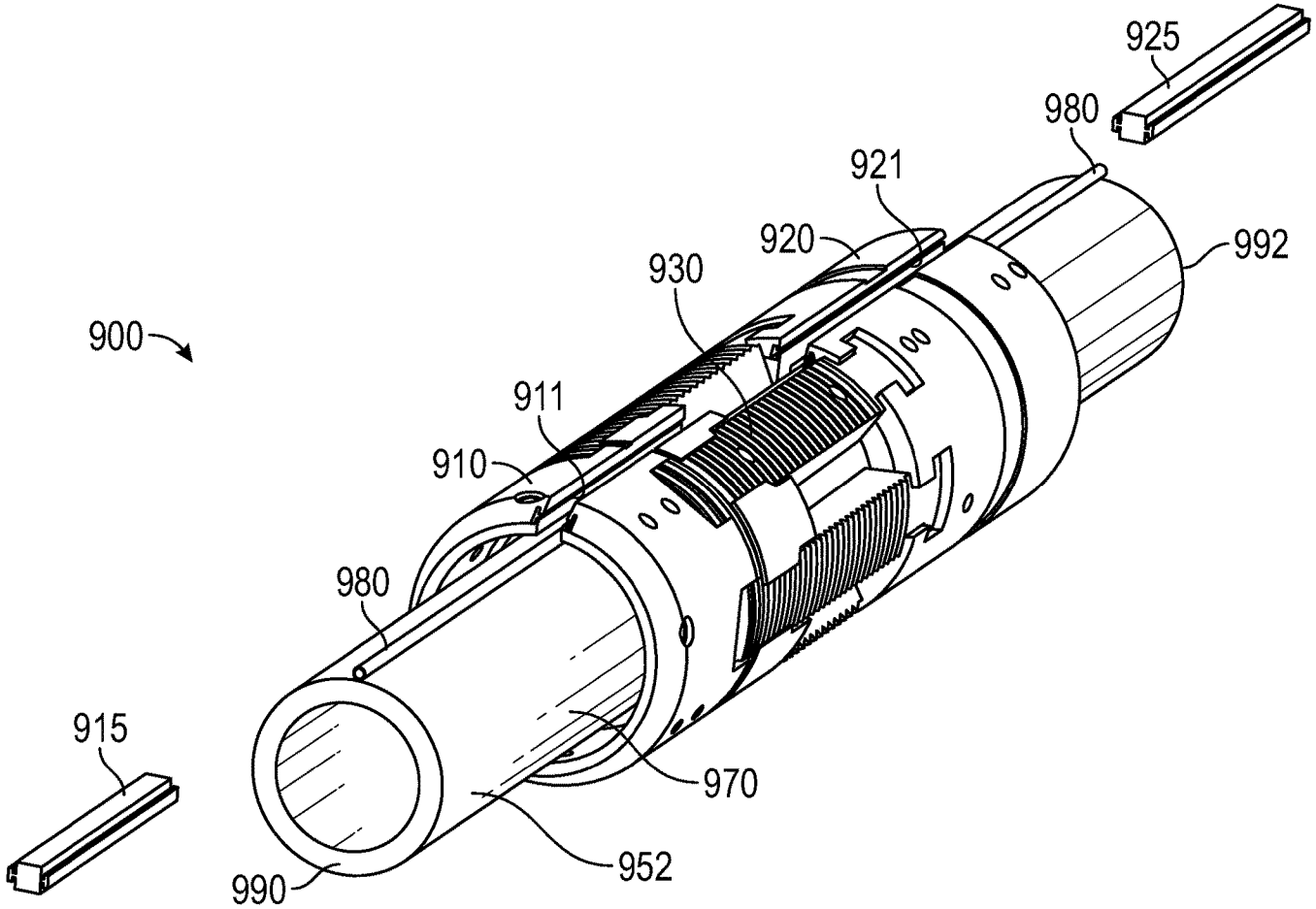
FIG. 9 is isometric schematic view of an embodiment of a downhole tool that includes locking keyed components.

FIG. 9 shows an embodiment of a downhole tool 900 that includes an external line 980 that runs along an exterior 970 of a mandrel 952 from a first end 990 of the mandrel 952 to a second end 992 of the mandrel. The tool 900 includes a plurality of slips 930 that may be set against a portion of a wellbore. The plurality of slips 930 may be actuated by various mechanisms as would be appreciated by one of ordinary skill in the art. The tool includes a first ring member 910 positioned around the exterior 970 of the mandrel 952 and a second ring member 920 position around the exterior 970 of the mandrel 952. The line 980 run between an interior of the ring members 910, 920 and the exterior 970 of the mandrel 952. The line 980 may be a continuous line from a surface location to a location within a wellbore below the tool 900 and may be used to communicate with and/or control a tool at location below the tool 900 within a wellbore. The ring members 910, 920 and key members 915, 925 permit a line to traverse the tool 900 without the need to splice into a line about and below the tool 900 as would be appreciated by one of ordinary skill in the art having the benefit of this disclosure. The ring members 910, 920 and key members 915, 925 may also enable onsite construction of the tool 900 at a wellbore.

The first ring member 910 includes a gap 911 that is configured to receive a first key 915 and the second ring member 920 includes a gap 921 that is configured to receive a second key member 925. The key members 915, 925 may be selectively inserted into their respective ring member 910, 920 to complete the ring members 910, 920, as discussed herein. The insertion and removal of the key members 915, 915 may permit the insertion of the line 980 through the tool 900, provide access to the line 980, permit the removal of the ring members 910, 920 of the tool 900 and line 980, and/or permit the installation of the ring members 910, 920 onto the mandrel 952 and the line 980. The key members 915, 925 may be retained within their respective gap 911, 921 via fasteners, friction fit, adhesive, welding, or by various other mechanisms as would be appreciated by one of ordinary skill in the art having the benefit of this disclosure. As discussed herein, a portion of the exterior 970 of the mandrel 952 may include a groove or recess to receive a portion of the line 980. The groove or recess may extend along the exterior 970 of the mandrel 952 from the first end 990 to the second end 992.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A packer system for use in a wellbore comprising:

a mandrel having an interior and an exterior;

a packer assembly including a packing element positioned between a first ring and a second ring, the packer assembly being configured to slide onto the exterior of the mandrel, wherein the first ring includes a first gap along the first ring between a first end and a second end;

a line configured to run between the exterior of the mandrel and an interior of the packing element, through an inner bore of the first ring, and through an inner bore of the second ring; and a first key member, wherein the first gap is configured to receive the first key member, wherein removal of the first key member from the first gap enables the line to pass from the inner bore of the first ring to an exterior of the first ring.

2. The packer system of claim 1, wherein the packer assembly is configured to slide onto the exterior of the mandrel onsite at the wellbore.

3. The packer system of claim 1, wherein insertion of the first key member into the first gap selectively interlocks the first key member with the first and second ends of the first ring.

4. The packer system of claim 1, wherein the first key member comprises a metal, a polymer, a thermoplastic, an elastomeric, or a combination thereof.

5. The packer system of claim 1, further comprising a second key member and a second gap configured to receive the second key member, the second gap being along the second ring between a first end and a second end, and wherein the insertion of the second key member into the second gap selectively interlocks the second key member with the first and second ends of the second ring.

6. The packer system of claim 5, wherein the first key has a first cross-sectional geometry and the second key has a second cross-sectional geometry, the second geometry differing from the first geometry.

7. The packer system of claim 5, wherein removal of the second key member from the second gap enables the line to pass from the inner bore of the second ring to an exterior of the second ring.

8. A method of providing a packer system comprising:

providing a packer assembly on a mandrel, the packer assembly including a first ring, a packing element, and a second ring, wherein the packing element is positioned between the first and second rings;

installing a line between an exterior of the mandrel and an inner surface of the packing element, through an inner bore of the first ring, and through an inner bore of the second;

wherein the line may be installed through a first gap along the first ring and a second gap along the second ring;

inserting a first key member into the first gap and inserting a second key member into the second gap after installing the line; and removing the first key member from the first gap and removing the first ring from the packer assembly, wherein the line passes from the inner bore of the first ring through the first gap.

9. The method of claim 8, wherein the packer assembly is provided on the mandrel onsite at a wellbore location.

10. The method of claim 8, wherein the first key member is inserted in a longitudinal direction with respect to a longitudinal centerline of the mandrel.

11. The method of claim 8, wherein the first key member is inserted in a transverse direction with respect to a longitudinal centerline of the mandrel.

12. The method of claim 8, wherein the first key member interlocks with the first ring and wherein the second key member interlocks with the second ring.

13. A packer system for use in a wellbore comprising:

a mandrel having an interior and an exterior;

a packer assembly including a packing element positioned between a first ring and a second ring, the packer assembly being configured to slide onto the exterior of the mandrel, wherein the first ring includes a first gap along the first ring between a first end and a second end;

a line configured to run between the exterior of the mandrel and an interior of the packing element, through an inner bore of the first ring, and through an inner bore of the second ring;

a first key member, wherein the first gap is configured to receive the first key member; and a second key member and a second gap along the first ring, the second gap between a third end and a fourth end and the second gap being configured to receive the second key member, wherein the insertion of the second key member into the second gap selectively interlocks the second key member with the third and fourth ends of the first ring.

14. The packer system of claim 13, wherein the first gap and the second gap are approximately 180 degrees apart along the first ring.

15. The packer system of claim 13, wherein the removal of the first key member from the first gap and the removal of the second key member from the second gap separates the first ring into two separate components.

* * * * *